United States Patent [19]

Ginatta et al.

[11] Patent Number: 5,015,342

[45] Date of Patent: May 14, 1991

[54] METHOD AND CELL FOR THE ELECTROLYTIC PRODUCTION OF A POLYVALENT METAL

[75] Inventors: Marco V. Ginatta; Gianmichele Orsello, both of Turin; Riccardo Berruti, Chieri, all of Italy

[73] Assignee: Ginatta Torno Titanium S.p.A., Turin, Italy

[21] Appl. No.: 340,356

[22] Filed: Apr. 19, 1989

[30] Foreign Application Priority Data

Apr. 19, 1988 [IT] Italy ..... 67364 A/88

[51] Int. Cl.[5] ..... C25C 3/26; C25C 3/08; C25C 3/12

[52] U.S. Cl. ..... 204/64 T; 204/243 R; 204/245; 204/284; 204/286

[58] Field of Search ..... 204/243 R–247, 204/260, 272, 64 T, 268, 280, 284, 283, 282, 287

[56] References Cited

U.S. PATENT DOCUMENTS

| | | | |
|---|---|---|---|
| 2,760,930 | 4/1956 | Alpert et al. | 204/231 X |
| 2,789,943 | 4/1957 | Kittelberger | 204/64 T |
| 3,029,193 | 4/1962 | Dean | 204/231 X |
| 3,082,159 | 3/1963 | Reimert | 204/64 T |
| 4,400,247 | 8/1983 | Ginatta | 204/64 R X |
| 4,443,306 | 4/1984 | Armand et al. | 204/64 T |

FOREIGN PATENT DOCUMENTS 1045667 12/1958 Fed. Rep. of Germany .

OTHER PUBLICATIONS

European Search Report.

*Primary Examiner*—Donald R. Valentine
*Attorney, Agent, or Firm*—Sughrue, Mion, Zinn, Macpeak & Seas

[57] ABSTRACT

In a method for the production of a polyvalent metal, particularly titanium, by the cathodic dissolution of a halide of the metal in an electrolyte of alkali or alaline earth metal halides and the electro-extraction of the dissolved metal ions, the electro-extraction stage is carried out with the use of a composite electrode including an anode and a framework surrounding the anode and provided with metal partitions capable of anodic dissolution for confining within the framework a bath of alkali or alkaline earth metal halides which does not contain ions of the metal to be produced, and then applying a potential between the anode and the framework to cause the formation of an accumulation of alkali metal or alkaline earth metal by cathodic reduction, after which a potential is applied between the anode and the cathode to cause the deposition of the metal to be produced at the cathode and the simultaneous anodic dissolution of the partitions.

The stage of cathodic dissolution of the halide is carried out separately from the extraction stage with the use of composite electrode similar to that used in the extraction stage.

12 Claims, 4 Drawing Sheets

METHOD AND CELL FOR THE ELECTROLYTIC PRODUCTION OF A POLYVALENT METAL

Figure 1:
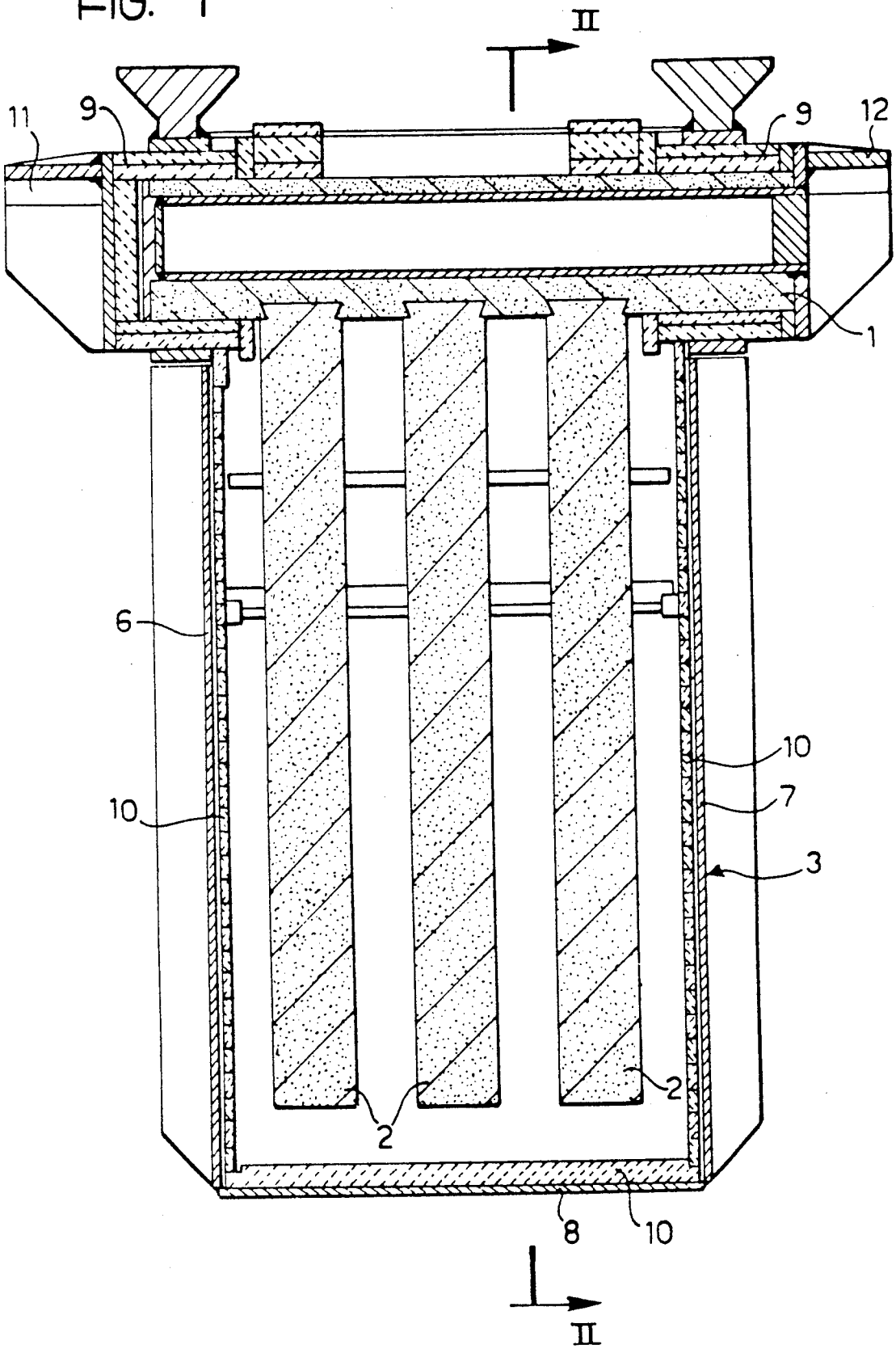

The present invention relates to a method for the electrolytic production of a polyvalent metal, such as titanium, zirconium or hafnium, by the cathodic dissolution of a halide of the metal in an electrolyte of alkali or alkaline earth metal halides in the fused state and the electro-extraction of the metal from the electrolyte.

The method more particularly concerns the preparation of titanium by the electrolysis of an electrolyte of fused halides.

The electrolytic production of titanium in a bath of fused salts differs from that of other, monovalent metals produced in the fused state in many ways which are reflected in particular operative problems.

As regards the aspects of a truly plant-engineering nature, the problems deriving from the cathodic deposition of the metal in the solid state and from the extreme reactivity of the metal and of its ions with air are well known. An important contribution to the solution of these problems is provided by the plant described in European patent application No. EP-A-0210961 in the name of the Applicant, whose descriptive content is to be considered as being incorporated in the present description by virtue of its citation. The plant described therein enables the electrolysis process to be operated continuously and the oxidation by air of the metal produced to be avoided, thus giving a high production yield and a metal product of good quality.

As regards the process, an important characteristic which differentiates the electrolysis of titanium from that of other metals commonly produced in fused salts is the difference between the valence of the titanium in the electrolyte and its valence in the raw material, titanium tetrachloride, which is not very soluble in the electrolyte. To enable efficient electrolytic extraction it is necessary to reduce the titanium tetrachloride to the divalent oxidation state which is soluble in the electrolyte.

Another important aspect of the electrolysis of titanium is connected with its multivalence in the electrolyte with the simultaneous presence of divalent and trivalent ions, the equilibrium of which is affected by conditions such as the temperature and the presence of impurities in the electrolyte. Since the efficiency of the electrolytic production is greater, the greater the percentage of divalent titanium, it is necessary to keep the average valence of the titanium in the electrolyte very low, generally no greater than 2.1.

A further important factor in the electrolysis of titanium is the high reactivity of the titanium ions in the electrolyte with the nascent chlorine, both the dissolved atoms and the dispersed gas, which make it necessary to keep the zone in which the chlorine is evolved separate from the rest of the electrolyte.

Because of this reactivity it is necessary to prevent the migration of the titanium ions by diffusion into the vicinity of the anode in order to avoid their oxidation to the trivalent oxidation state, their reaction with nascent chlorine, and the formation of $TiCl_3$ which is volatile at the operating temperature, whilst at the same time maintaining the ion transfer between the cathode and the anode due to the chlorine ions.

In order to increase the efficiency of the titanium extraction, the difficulties connected with the factors described above being taken into account, it was proposed in U.S. patent application Ser. No. 2,789,943 to interpose a conductive diaphragm between the anode and the cathode, surrounding the anode and having walls which were permeable to the electrolyte and adapted to support a deposit in the form of a panel(overlay) of the metal to be produced, and to connect this diaphragm to the electrical supply circuit of the cell so as to give it a negative potential relative to the anode in order to cause the formation of a cathodic deposit of the metal to be produced on the permeable walls of the diaphragm which has a permeability such as to allow the ion transfer due to the chlorine ions but substantially to prevent the migration of titanium ions by diffusion from the cathode towards the anode.

European patent EP-B-53564 describes a method for controlling the permeability of the diaphragm covered with the deposit of the metal to be obtained which is achieved by causing the metal deposit to increase or dissolve in dependence on the voltage drop in the electrolyte which impregnates the diaphragm itself.

The first of the methods cited above does not enable continuous operating conditions to be maintained industrially because of the continuous variation in the thickness of the deposited panel which itself constitutes the mass of metal produced to be removed periodically so that the operator has to repeat the starting up procedure several times a day.

The method according to the aforesaid EP-B-53564 does not enable the oxidation of the divalent titanium in the cathodic compartment and the consequent increase in the average valence of the titanium in the bath to be prevented during the formation of the metal deposit on the diaphragm, and this inevitably leads to a low extraction efficiency.

Both the methods described in the patents mentioned above require complex starting procedures which are expensive in terms of time and electrical energy and very difficult to control. In these methods, the starting-up which is carried out with the diaphragm open, starting with a mass of electrolyte which does not contain ions of the metal to be produced, requires a sequence of operations which is unacceptable for industrial production.

In order to avoid these problems, a first subject of the present invention is a method of the type indicated in the introduction to the present description, in which the stage of electro-extraction of the metal is carried out in a cell including at least one anode and one cathode and a conductive framework which acts as an intermediate electrode and surrounds the anode so as to define an anodic compartment and a cathodic compartment, and has walls which are permeable to the electrolyte and are able to support a deposit of the metal to be produced in the form of a panel so as to allow ionic transfer between the cathodic and the anodic compartments but to limit substantially the transfer of the ions of the metal to be produced from the cathodic compartment to the anodic compartment, characterised in that it includes the steps of:

(a) supplying the extraction cell with electrolyte containing ions of the metal to be produced in solution, (b) confining, within the framework, a bath of alkali metal or alkaline earth metal halides which is substantially free of ions of the metal to be produced by the electrolyte-tight screening of the permeable walls of the framework with metal partitions which are capable of anodic dissolution, (c) feeding an electric current between the anode and the framework such as to cause cathodic deposition of the alkali metal or alkaline earth metal on the permeable walls of the framework for a sufficient period of time to cause an accumulation of this metal, (d) feeding an electric current between the anode and the cathode such as to cause the deposition of the metal to be produced on the cathode with the simultaneous anodic dissolution of the partitions, so as to enable the diffusion of ions of the metal to be produced from the cathodic compartment towards the anodic compartment with the formation of the deposit of the metal to be produced on the permeable walls of the framework as a result of the reduction of the metal ions by means of the alkali or alkaline earth metal, (e) maintaining the electric current feed the anode and the cathode in order to deposit the metal at the cathode and simultaneously (f) regulating the current between the anode and the framework so as to keep the permeability of the deposit substantially constant.

During step (f), the intensity of the current between the anode and the framework constituting the intermediate electrode is kept at a magnitude such as to cause the deposition of the alkali metal or alkaline earth metal on the interface of the framework which faces the anodic compartment at a rate sufficient to reduce the ions of the metal to be produced (e.g. $Ti^{2+}$), which flow by diffusion from the cathodic compartment, to the metallic state, and so as to establish a state of substantial equilibrium between the flow of these ions ($Ti^{2+}$) which are being deposited and the anodic dissolution flow of the metal (e.g. titanium) being deposited to the interface of the framework which faces the cathodic compartment.

A further subject of the invention is a composite electrode particularly for carrying out the method described above for the electrolytic production of a polyvalent metal in a fused-halide electrolyte, including:

at least one anode provided with a terminal for its electrical connection, an electrically-conductive framework insulated from the anode, provided with a terminal for its electrical connection and surrounding the anode in the form of a basket, the framework having wall portions facing the anode which are permeable to the electrolyte and adapted to support a cathodic metal deposit, characterised in that it has support means associated with the walls of the framework for supporting sealing elements in the form of partitions, adjacent the electrolyte-permeable wall portions, for confining within the framework an electrolytic bath which is free from the metal to be produced, and for preventing the infiltration of the electrolyte into the interior of the framework through the permeable wall portions, the partition-like sealing elements being constituted by a metal which is capable of anodic dissolution under the operating conditions of the electrode.

Figure 2:
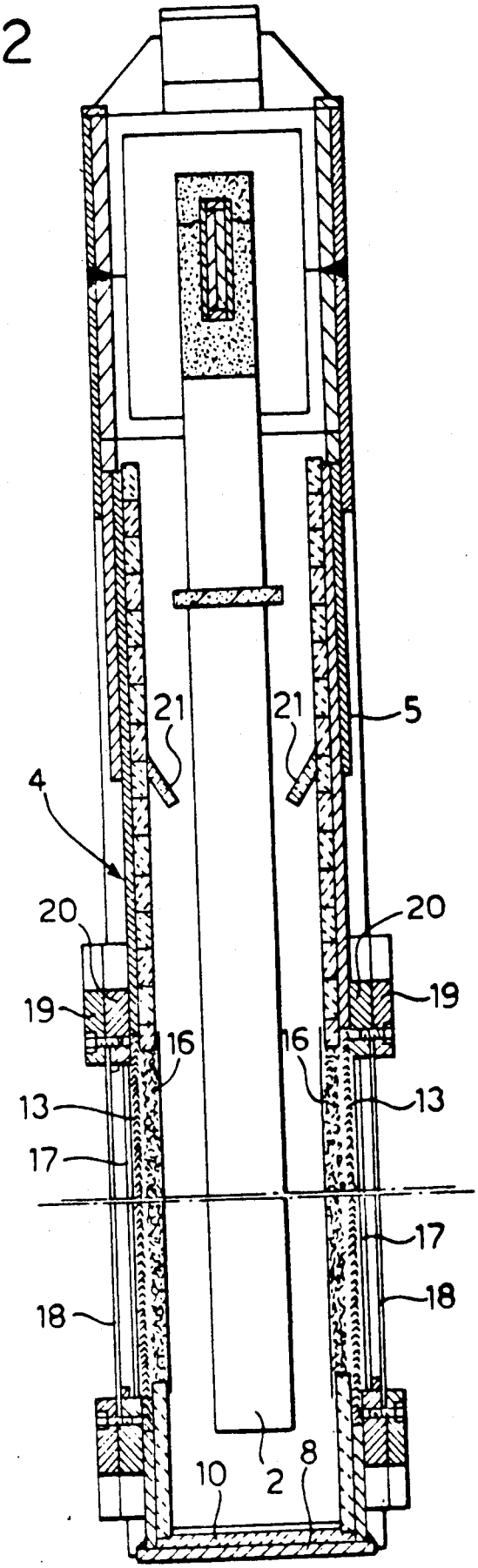
Figure 7:
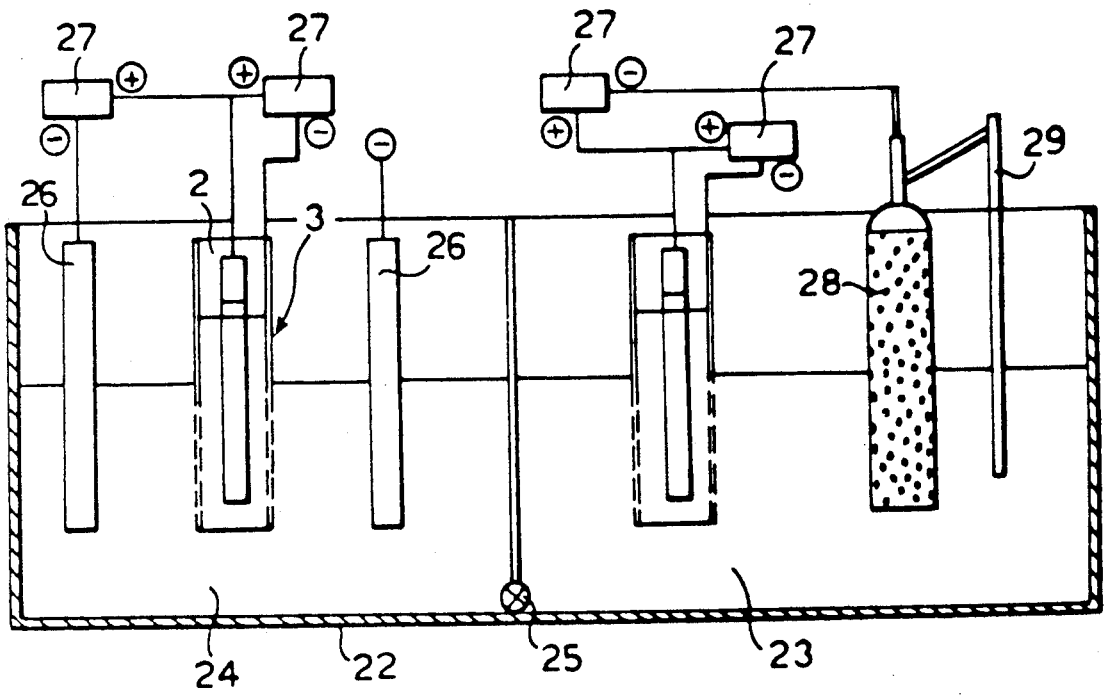
Figure 4:
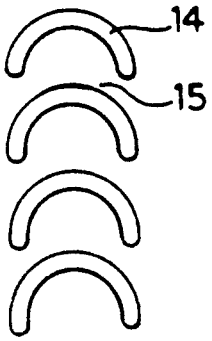
Figure 5:
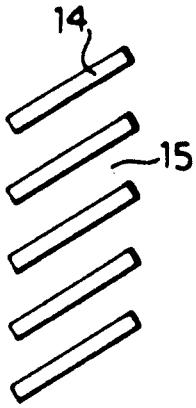
Figure 6:
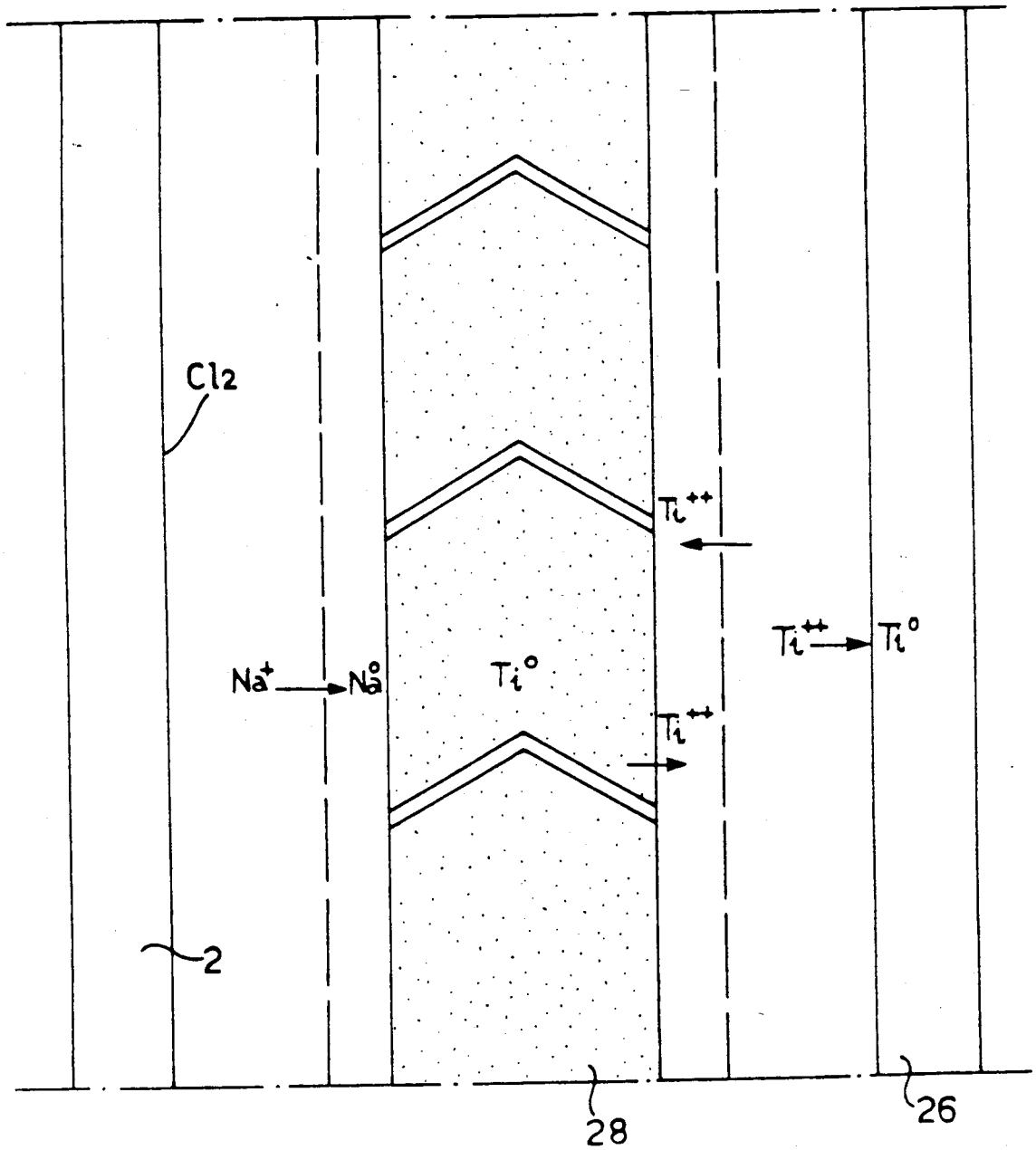

Further characteristics and advantages of the method and of the device according to the invention will become clear from the detailed description which follows with reference to the appended drawings, provided purely by way of non-limiting example, in which:

FIG. 1 is a frontal section of a composite electrode according to the invention, FIG. 2 is a view taken on the line II—II of FIG. 1, FIGS. 3 to 5 are sectional views of a detail of FIG. 1 according to different embodiments, FIG. 6 is a schematic view which shows the mechanism by which the metal is extracted, and FIG. 7 is a schematic view of the plant for carrying out the method.

The electrode illustrated in FIGS. 1 and 2 is particularly adapted for use in a plant of the type described in the aforesaid European patent application No. EP-A-0210961 which describes electrodes for suspension in a bath of fused salts supported by support means and electrical connection means constituted by a pair of electrically-conductive members which face each other and are supported respectively by opposite walls of the crucible containing the fused salt bath.

The electrode illustrated in FIGS. 1 and 2 is similarly provided with a pair of supports described in greater detail below; it is, however, understood that the innovative principle of the electrode according to the invention can be applied regardless of the technical details of its electrical connection. The composite electrode itself will also be referred to below in the present specification by the abbreviation TA, since it is constituted essentially by a Bipolar Titanium Electrode (TEB) which is formed in situ during the initiating stage of the extraction process, and by an anode A.

With reference to the drawings, the electrode according to the invention includes an anodic graphite cross-member 1 which supports three anodic graphite bars 2 by mortize joint. A generally parallelepipedal metal framework which surrounds the anodic bars 2 like a basket is indicated 3. The framework 3 has flat side walls 4, 5, 6, and 7 and a base wall 8. The top portion of the framework 3 surrounds the anodic cross member 1 and is electrically insulated therefrom by means of prismatic sleeves 9 of insulating refractory material. The side walls 6 and 7 and the base wall 8, like the upper portions of the side walls 4 and 5, are covered with panels 10 of insulating, refractory material. A concave element 11 is mechanically and electrically connected to the framework 3 but is insulated electrically from the anodic cross member and is intended to act as a support and terminal for the connection of the framework to a supply of electromotive force (rectifier not illustrated).

A similar concave support element 12, electrically insulated from the framework 3, is connected electrically to the anodic cross member 1 and acts as the terminal for its electrical connection.

Figure 3:
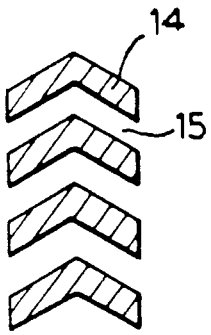

The front walls 4 and 5 of the framework each have an aperture in which there is mounted a grating 13 formed by a plurality of tile-shaped elements 14 arranged in horizontal rows and defining passages 15 between them through which the electrolyte can flow. FIGS. 3 to 5 show three different configurations of each tile-shaped element which, as will be seen in more detail below, are particularly suitable, for enabling the alkali metal or alkaline earth metal deposited by cathodic reduction to accumulate during the operation of the electrode. The configuration of the tile-shaped element of FIG. 3, with a V-shaped cross section, is particularly preferred.

A refractory ceramic fibre panel 16 which is permeable to the electrolyte is mounted adjacent each grating 13 of the side which faces towards the anodic bars. A plurality of grid members 17 are mounted on the opposite side of the grating.

Metal partitions indicated 18 are releasably mounted so as to form an electrolyte-tight seal between two annular frame members 19 and 20. Each partition 18, which is preferably constituted by a sheet of the very metal which it is intended to produce with the aid of the composite electrode, acts as a sealing member which closes the apertures in the side walls 4 and 5, enabling an electrolytic bath of fused salts in which the anodic bars are immersed to be confined within the cavity defined by the framework 3, while simultaneously preventing the infiltration into this cavity of the production electrolyte which is outside the anode, during the initiating stage of the extraction process.

The electrode according to the invention is also provided with deflectors 21 for reducing spray caused by the formation of chlorine bubbles evolved at the anode and the consequent entrainment of the electrolyte towards the anodic cross member when the electrode is in operation.

The method for the production of a polyvalent metal, which will be given below with particular reference to the production of titanium, is preferably carried out in a plant of the type described in European patent application No. EP-A-0210961 in the name of the Applicant.

As illustrated schematically in FIG. 7, a crucible 22 is used which, to advantage, is divided into a first cell 23 for the dissolution of the tetrachloride and a second, extraction cell 24 for the deposition of the metallic titanium at the cathode. The dissolution and extraction cells intercommunicate through valve means 25.

With reference initially to the metal extraction stage, an electrolyte is supplied to the extraction cell from the dissolution cell and is constituted by a bath of alkali metal halides or alkaline earth metal halides containing titanium in solution. The electrolyte is preferably constituted by sodium chloride. The use of sodium chloride has numerous advantages over other electrolytes by virtue of the simple structure of the liquid which does not form complexes which would interfere with the titanium deposition mechanism and which, by condensing on the walls of the crucible above the level of the bath, forms a solid, adherent layer which forms a good protection for the materials against the corrosive action of the gaseous chlorine.

At the start of the extraction operation, the bath preferably has a titanium concentration of between 3 and 10% with an average valence of no more than 2.1.

The extraction cell includes at least one cathode 26 and at least one composite electrode (TA) of the type described above. During the stage of initiation of the electro-extraction, the framework 3 of the composite electrode is provided with partitions 18 constituted by titanium sheets, and an electrolytic bath of fused halide salts of alkali or alkaline earth metals, preferably sodium chloride, substantially without titanium ions, is confined within the framework.

The temperature of the electrolyte is regulated to a value preferably between 800° and 880° C. The process is carried out in a sub-atmospheric pressure environment.

After the composite electrode has been positioned in the electrolyte, a potential is applied, through a rectifier 27, between the anode 2 and the metal framework 3 which assumes a negative potential relative to the anode, the intensity of the current produced being such as to cause the cathodic deposition of the alkali metal or alkaline earth metal, preferably sodium, on the gratings 13. The tiled structure of the gratings encourages the accumulation of metallic sodium in the downward-facing concavity of each tile-shaped element, since the sodium, which is lighter than the electrolyte, tends to rise and remains trapped under the arched wall of each tile-shaped element. The potential is applied between the anode and the framework until a substantial accumulation of sodium has been obtained.

A potential is then applied between the anode 2 and the cathode 26, so as to cause titanium to be deposited and the simultaneous anodic dissolution of the confining partitions 18. As a result of the anodic dissolution of the partitions 18, a transfer of material is established between the electrolyte outside the framework, which contains titanium ions, and the bath within the framework. The $Ti^{2+}$ ions migrate by diffusion towards the anode and are reduced to metallic titanium with the help of the sodium which has accumulated within the grating structure 13, thus forming a micro-crystalline deposit in the form of porous panels which act as permeable diaphragms to the ionic transfer of the chloride ions but are substantially impermeable to the flow of $Ti^{2+}$ ions by diffusion towards the anode.

FIG. 6 shows schematically the mechanism which is set up as a result of the formation of a porous panel of micro-crystalline titanium indicated 28.

It should be remembered that the panel simultaneously becomes the seat of several processes so that the panel itself operates like an electrode with the following functions:

(1) the surface of the panel which faces the anode acts as a monopolar cathode; there is a limited production of metallic sodium on the panel with an independent electrical supply;

(2) the opposite face of the panel from that mentioned above acts as a monopolar cathode at which the reaction:

$$Ti^{3+} + e^- \rightarrow Ti^{2+}$$

takes place, whereby the average valence of the electrolyte is kept low;

(3) the interior of the panel acts as a monopolar cathode, in which the half reaction:

$$Ti^{2+} + 2e^- \rightarrow Ti$$

takes place with the formation of fine crystalline titanium;

(4) as a bipolar electrode for a fraction of the current supplied between the production cathodes and the anodes, with a limited production of sodium at the interface which faces the anode and oxidation of $Ti^{O}$ to $Ti^{2+}$ at the interface which faces the cathode; and also (5) as a diaphragm which allows the unimpeded passage of the $Cl^-$ ions carrying the ionic current between the cathodes and the anodes, with substantially complete precipitation of the titanium ions at the interface which faces the cathode, caused by the reaction with the sodium made available by the processes (1) and (4) described above.

The potential applied between the anode and the cathode is then maintained to achieve the deposition of the titanium at the cathode, and the current between the anode and the panel is regulated simultaneously so as to keep the permeability of the panel substantially constant. For this purpose, the intensity of the current between the anode and the panel is regulated preferably to a value such as to cause a deposition flow of sodium at the interface facing the anode which is sufficient to precipitate the flow of $Ti^{2+}$ ions which reach the cathodic interface of the panel by diffusion from the catholyte and such that a state of substantial equilibrium is achieved between the reduction of the $Ti^{2+}$ ions and the anodic dissolution of the $Ti^{O}$ at the interface facing the cathode.

With the use of a plant of the type described in application No. EP-A-0210961, it is particularly easy to replace a mature cathode by a new cathode, without interrupting the production cycle.

A further innovative aspect of the method of the invention lies in the steps for the dissolution of the raw material for enriching the titanium concentration in the electrolyte to be supplied to the extraction cell. The dissolution is carried out with the help of a dissolution cathode 28 connected to a rectifier 27 and constituted by a metal structure with a large surface area immersed in the electrolyte and into which, outside which or adjacent which, liquid titanium tetrachloride is supplied by means of a nozzle 29. The operation may, to advantage, be carried out with the aid of a TA composite electrode of the type described above, initially provided with confining partitions of titanium and including a bath of sodium chloride substantially free from titanium ions within the framework.

If one starts, for example, with an exhausted electrolyte having a titanium ion concentration of the order of 2%, with an average valence of approximately 2.1, a potential is applied between the anode and the framework so as to cause the deposition of sodium by the mechanism described above with reference to the extraction stage, and a potential is then applied between the dissolution cathode and the anode in order to cause the formation of the panel of titanium.

Titanium tetrachloride is then supplied to the dissolution cathode at a rate which is essentially in a stoichiometric ratio with the electrical current supplied to the dissolution cathode in order to enrich the electrolyte to give the desired concentration of the titanium ions in solution, which is generally approximately 10%.

The dissolution process may be represented by the reactions:

$$TiCl_4 \rightarrow TiCl_2 + Cl_2$$

that is, by the cathodic half reaction $$TiCl_4 + 2e^{31} \rightarrow Ti^{2+} + 4Cl^-$$

and the anodic half reaction:

$$2Cl^{31} \rightarrow Cl_2 + 2e^-$$

It should be remembered that, in reality, the cathodic process involves the $Ti^{3+}$ ion according to the reaction:

$$2Ti^{3+} 2e^- \rightarrow 2Ti^{2+}$$

the $Ti^{3+}$ ion being produced by the chemical reaction:

$$TiCl_4 + Ti^{2+} \rightarrow 2Ti^{3+} + 4Cl^-$$

After the first stage in which the concentration of the titanium dissolved in the electrolyte is enhanced, it is preferable to provide for a further reduction in the average valence of the dissolved titanium by means of a "soaking" operation, by stopping the supply of titanium tetrachloride, reducing the current supplied to the dissolution cathode and adjusting the intensity of the current at the composite electrode, between the anode and the panel, to a value such as to maintain the production of metallic sodium at the anodic interface of the panel and to continue the reduction of the trivalent titanium to the divalent state at the cathodic interface of the intermediate electrode.

During this operation, the chlorine evolved at the anode is conveyed to the outside and the sodium produced within the TEB reacts with the high valence electrolyte according to the reaction:

$$TiCl_2 + 2Na \rightarrow Ti + 2NaCl \quad (1)$$

$$2TiCl_3 + Ti \rightarrow 3TiCl_2 \quad (2)$$

or better:

$$TiCl_3 + Na \rightarrow TiCl_2 + NaCl \quad (3)$$

Alternatively, it may be thought that the high reducing efficiency of the cathodic interface is due to the direct reaction of the $Ti^{3+}$ with the electrons supplied to the intermediate TEB electrode described above, this reaction being more favoured from an energy point of view than the deposition of metallic sodium, in spite of the configuration of the current paths with greatest resistance.

After the soaking operation it is possible to achieve not only the chemical equilibrium of the reaction (2) given above with an average valence at 825° of 2.07 but, by continuing the electrochemical reaction $Ti^{3+} e^- \rightarrow Ti^{2+}$, it is possible to achieve average valences without equilibrium of between 2.00 and 2.07.

When the dissolution stage is completed and a suitable average valence has been reached in the bath, the valve means 25 are opened for sufficient time to allow the electrolyte in the extraction cell and in the dissolution cell to become homogeneous.

According to one variant, the dissolution process may be carried out without the supply of current to the dissolution cathode but with the use of a TA composite electrode described above, to which there is supplied, between the anode and the intermediate TEB electrode, a total current which is made up of the sum of two currents:

(a) a first current which corresponds to the stoichiometric ratio with the flow of the tetrachloride supplied to the dissolver according to the reaction:

$$2Ti^{3+} + 2e^- \rightarrow 2Ti^{2+}$$

and (b) a second current which corresponds to the current needed to maintain sufficient production of metallic sodium for the precipitation of the $Ti^{2+}$ as $Ti^{O}$.

In this variant, it is possible to eliminate the dissolution cathode, retaining only the injection nozzle. As regards the stage in which the titanium confining partitions 18 of the TA composite electrode are dissolved, in the absence of the dissolution cathode, a cathodic current can be supplied to the metal wall of the crucible to cause the anodic dissolution of these partitions.

The soaking operation for reducing the average valence of the titanium dissolved in the electrolyte may, according to one variant, be carried out by allowing the electrolyte containing $TiCl_4$ and $TiCl_3$ and having an average valence greater than 2.1 to react spontaneously with metallic titanium constituted, for example, by scraps or by titanium recycled from the extraction cell, in the absence of current, according to the reaction:

$$2TiCl_3 + Ti \rightarrow 3TiCl_2$$

This operation may be carried out for a period of between 12 and 16 hours.

In summary, the preferred procedures are as follows:

(1) Dissolution cell including metallic titanium added to the bath:

(a) injection of titanium tetrachloride for approximately 8 hours with the mechanical valves 25 between the extraction cell and the dissolution cell closed;

(b) soaking for approximately 16 hours without current, during the last two hours of which the mechanical valves 25 are open;

(2) Dissolution cell not including added metallic titanium:

(a) injection of the tetrachloride for approximately 16 hours with the mechanical valves closed;

(b) soaking for approximately eight hours with a limited current to the TEB, during the last two hours of which the mechanical valves are open.

It is also possible to maintain the extraction stage and the dissolution stage simultaneously by maintaining the circulation of the electrolyte between the extraction cell and the dissolution cell through the valve 25 and regulating the operating parameters of the cathodic dissolution cell, in particular the supply of the halide, the current to the dissolver and the current to the framework of the intermediate electrode, so as to maintain the concentration and the average valence of the dissolved titanium ions at their operational values.

EXAMPLE 1

The method for the production of titanium is carried out with the use of the plant described in patent application No. EP-A-0210961 in which the crucible is divided into an extraction cell and a dissolution cell. The extraction cell includes 6 iron cathodes each with a surface area of 2 $m^2$ and 5 TA composite electrodes provided with titanium confinement partitions and including a bath of sodium chloride within the framework, as described above. The electrolytic bath is constituted by sodium chloride and titanium chloride with 5% by weight of Ti.

At the initiation stage, a current of approximately 4000 $A/m^2$ of cathodic surface area is supplied to the TA of the extraction cell for a period of 1 hour, after which the operating conditions are achieved by the supply of a current of 1500 $A/m^2$ to the cathodes and a current of 500 $A/m^2$ of cathodic surface area to the TEB and cell voltages of the order of 6.5 V between the anode and the cathode and 5.5 V between the anode and the TEB are set.

In the dissolution cell, which is constituted by three dissolution cathodes each having a geometric surface area of 2 $m^2$ and two TA composite electrodes, a current of 4000 $A/m^2$ of cathodic surface area is supplied to the TA during the initiation stage for a period of 1 hour simultaneously with the starting of the extraction cells, and then an operating current of 2500 $A/m^2$ is supplied to the dissolution cathodes and a current of 500 $A/m^2$ of cathodic surface area is supplied to the TEB and cell voltages of the order of 6 V between the anode and the cathode and 5.5 V between the anode and the TEB are set, with a supply of 33.5 kg/hour of $TiCl_4$.

In 12 hours approximately 12 kg of titanium are collected per square meter of cathode, which, after leaching, is of the quality indicated in Table 1.

TABLE 1

ANALYSIS OF THE ELECTROLYTIC DEPOSITION OF TITANIUM

| Element | Concentration of impurities (ppm) Conventional Value | Method According to the invention |
|---|---|---|
| Oxygen | 650 | 390 |
| Nitrogen | 35 | 25 |
| Carbon | 85 | 50 |
| Chloride | 1400 | 160 |
| Iron | 200 | 50 |
| Hydrogen | 325 | 217 |
| Aluminium | 100 | 50 |
| Vanadium | 100 | 50 |
| Manganese | 100 | 50 |
| Nickel | 100 | 50 |
| Chromium | 100 | 50 |
| Molybdenum | 100 | 50 |
| Tin | 100 | 50 |
| Copper | 100 | 50 |
| Silicon | 100 | 50 |
| Zirconium | 100 | 50 |
| Boron | 100 | 30 |
| Yttrium | 100 | 10 |
| Magnesium | 100 | 10 |
| Sodium | 1100 | 100 |
| Phosphorus | 30 | 30 |
| *BHN | 90/100 | 85/86 |

*BHN: Brinnel hardness number

We claim:

1. An electrolytic cell for use in combination with at least one cathode for the electrolytic production of a polyvalent metal in an electrolyte of fused halides including:

at least one anode provided with a terminal for its electrical connection, a conductive framework, which is electrically insulated from the anode and provided with a terminal for its electrical connection, the framework surrounding the anode like a basket and having wall portions facing the anode which are permeable to the electrolyte and are adapted to support a cathodic metal deposit, and having support means (19,20) associated with the walls (4,5) of the framework (3) for supporting partition-like sealing elements (18) adjacent the electrolyte-permeable wall portions in order to confine within the framework, an electrolytic bath which does not contain the metal to be produced, and to prevent the infiltration of the electrolyte into the framework through the permeable wall portions, the partition-like sealing elements being constituted by a metal capable of anodic dissolution under the operating conditions of the electrode.

2. An electrolytic cell according to claim 1, wherein the electrolyte-permeable wall portions are constituted by grating members (13) formed by a plurality of tile-shaped elements (14) arranged in horizontal rows and defining passages (15) for the electrolyte.

3. An electrolytic cell according to claim 2, wherein each of the tile-shaped elements has a V-shaped cross section.

4. An electrolytic cell according to claim 1, wherein the anode is formed by an anodic cross member (1) and a plurality of anodic bars (2) extending substantially perpendicular to the cross member and wherein the cross member is supported at its ends by a first concave support terminal (12) which is electrically connected to the cross member and by a second concave support terminal (11) which is electrically connected to the framework.

5. An electrolytic cell according to claim 1, wherein the walls of the framework support a plurality of deflector elements (21) on their surfaces which face towards the interior of the framework.

6. A method for the production of a polyvalent metal selected from the group consisting of titanium, zirconium and hafnium, by means of:

the cathodic dissolution of a halide of the metal in an electrolyte of alkali metal of alkaline earth metal halides in the fused state and the electro-extraction of the metal carried out in a cell including at least one anode and one cathode and a conductive framework which acts as an intermediate electrode and surrounds the anode so as to define an anodic compartment and a cathodic compartment, the framework having walls which are permeable to the electrolyte and are adapted to support a deposit of the metal to be produced in the form of a panel, so as to allow ion transfer between the anodic and cathodic compartments but to limit the transfer of ions of the metal to be produced from the cathodic compartment to the anodic compartment, comprising the steps of:

(a) supplying the extraction cell with the electrolyte containing ions of the metal to be produced in solution.

(b) confining a bath of alkali metal halides or alkaline earth metal halides, which is substantially without ions of the metal to be produced, within the framework by means of electrolyte-tight sealing of the permeable walls of the framework by metal partitions which are capable of anodic dissolution, (c) feeding an electric current between the anode and the framework so as to cause the cathodic deposition of the alkali metal or alkaline earth metal on the permeable walls of the framework for a sufficient period of time to cause an accumulation of this metal, (d) feeding an electric current between the anode and the cathode so as to cause the deposition of the metal to be produced at the cathode and the simultaneous anodic dissolution of the partitions so as to cause the diffusion of ions of the metal to be produced from the cathodic compartment towards the anodic compartment with the formation of the deposit of the metal to be produced on the permeable walls of the framework as a result of the reduction of the metal ions by the alkali metal or the alkaline earth metal, (e) maintaining the electric current feed between the anode and the cathode to achieve the deposition of the metal at the cathode and simultaneously (f) regulating the current between the anode and the cathode and the framework so as to keep the characteristics of permeability of the deposit substantially constant.

7. A method according to claim 6, wherein during step (f) the intensity of the current between the anode and the framework is regulated to a magnitude such as to cause the alkali metal or alkaline earth metal to be deposited by cathodic reduction at the interface of the framework which faces the anodic compartment at a deposition rate sufficient to reduce to the metallic state the ions of the metal to be produced which diffuse from the cathodic compartment, and such as to establish a state of substantial equilibrium between the depositing flow of ions of the metal to be produced and the flow of anodic dissolution of the metal being deposited at the interface of the framework which faces the cathodic compartment.

8. A method according to claim 6 in which the cathodic dissolution of the halide of the metal to be produced is carried out in a cell which is separate from the extraction cell and which communicates therewith through valve means, and in which the cathodic dissolution of the halide of the metal to be produced to enrich the electrolyte to be supplied to the extraction cell with ions of the metal to be produced, comprises the steps of:

(g) providing in the dissolution cell a dissolution cathode and a composite electrode comprised of said anode and said framework which confines within its framework, provided with the partitions, a bath of alkali metal or alkaline earth metal halides free from ions of the metal to be produced, (h) applying a potential between the anode and the framework of the composite electrode to cause the deposition of the alkali metal or alkaline earth metal on the permeable walls of the framework for a sufficient period of time to cause an accumulation of the metal, (i) applying a potential between the anode and the dissolution cathode so as to cause the anodic dissolution of the partitions and the formation of the deposit of the metal to be produced on the permeable walls of the framework and (1) supplying the tetrachloride of the metal to be produced to the dissolution cathode at a rate substantially in the stoichiometric ration with the electrical current supplied to the dissolution cathode in order to cause enrichment of the electrolyte to the desired value.

9. A method according to claim 8 in which the stage of enrichment of the electrolyte with dissolved ions of the metal to be produced is followed by a stage of reduction of the average valence of the ions of the metal dissolved in the electrolyte, carried out without the supply of tetrachloride to the dissolution cell and with a supply of current to the composite electrode and of an intensity such as to maintain the production of the alkali metal or the alkaline earth metal at the anodic interface of the framework and the reduction of the trivalent titanium to the divalent state at the cathodic interface of the framework.

10. A method according to claim 6, in which the cathodic dissolution of the halide of the metal to be produced is carried out in a cell separate from the extraction cell and which communicates therewith through valve means, and in which the cathodic dissolution of the halide of the metal to be produced to enrich the electrolyte to be supplied to the extraction cell with the dissolved metal ions is carried out with the use of a composite electrode comprised of said anode and said framework by providing for the formation of the deposit of the metal to be produced on the walls of the framework of the electrode and by injecting the tetrachloride of the metal to be produced into the electrolytic bath in the absence of a cathodic current and supplying a current to the composite electrode between the anode and the framework, the current having an intensity substantially equal to the sum of a first current which corresponds to the stoichiometric ratio with the flow of tetrachloride injected into the bath, according to the reaction $2Ti^{3+} \rightarrow 2e^{-} \rightarrow 2Ti^{2+}$ and of the current necessary to maintain sufficient production of the alkali metal of the alkaline earth metal on the framework of the composite electrode to precipitate the divalent metal ion.

11. A method according to claim 6, in which the dissolution and extraction steps are carried out in an environment at sub-atmospheric pressure.

12. A method according to claim 6 in which the electrolyte is constituted by a bath of sodium chloride.

* * * * *